United States Patent [19]

Relyea

[11] Patent Number: 4,813,753

[45] Date of Patent: Mar. 21, 1989

[54] DRUG CONTROL AND DISPENSING ASSEMBLY

[75] Inventor: Christopher M. Relyea, Grove City, Ohio

[73] Assignee: Drustar Inc., Grove City, Ohio

[21] Appl. No.: 35,098

[22] Filed: Apr. 6, 1987

[51] Int. Cl.[4] ..... A47B 91/00

[52] U.S. Cl. ..... 312/291; 312/209; 220/256; 220/259

[58] Field of Search ..... 220/256, 259; 312/291, 312/292, 308, 209, 204

[56] References Cited

U.S. PATENT DOCUMENTS

| | | | |
|---|---|---|---|
| 333,123 | 12/1885 | Goldsmith | 220/259 X |
| 1,512,148 | 11/1924 | Canfield | 312/291 X |
| 2,233,699 | 3/1941 | Gorrell | 312/291 X |
| 2,783,115 | 2/1957 | York | 312/291 X |

*Primary Examiner*—Joseph Falk
*Attorney, Agent, or Firm*—Frost & Jacobs

[57] ABSTRACT

A drug control and dispensing assembly for use alone or with the drawers of a medicine dispensing cabinet or cart. The assembly comprises at least one carton containing medicines and an open top tray to receive the at least one carton. The tray comprises a pair of side walls, a pair of end walls, and a bottom. The carton is generally rectangular having first and second side walls, end walls, a bottom and a flap-like planar top. When received within the tray, the carton extends slightly above the upper edge of the tray walls. The tray has at least one individual lid corresponding to and overlying the top of the at least one carton. The tray lid is pivotally mounted in a pair of upstanding hinge elements located on the upper edges of the tray side walls. At least one of the carton top and the tray lid is provided with attachment devices to releasably attach the carton top to the tray lid such that opening and closing of the tray lid will simultaneously open and close the carton top. The tray lid is preferably made of transparent material so that indicia on the carton top can be read therethrough. In a preferred embodiment, the tray is dimensioned to receive a plurality of such cartons and is provided with an individual hinged lid for each such carton, each lid releasably attachable to the top of its respective carton.

9 Claims, 9 Drawing Sheets

DRUG CONTROL AND DISPENSING ASSEMBLY

TECHNICAL FIELD

The invention relates to a drug control and dispensing assembly comprising one or more cartons each containing drug doses and each having a planar flap-like top, together with a tray sized to receive the one or more cartons and having an individual hinged lid for each carton located therein, and more particularly to such an assembly including means to temporarily affix the carton top to its respective tray lid so that opening and closing of the tray lid will simultaneously open and close the carton top.

BACKGROUND ART

Prior art workers have devised numerous types of drug control and dispensing apparatus for use in hospitals, nursing homes and the like to assure that a patient receives proper medication in proper doses at required times. For example, it is known to provide cardboard cartons to be filled by a pharmacist with medicine arranged in doses and to be sealed and labeled by the pharmacist. The cardboard cartons are adapted to be arranged in trays, each tray provided with a removable cover or lid. Each carton, when opened by the nurse or person in charge of dispensing the medicine, has a portion of its top removed to define a dispensing opening. The remainder of the top remains intact and contains the label from the pharmacist.

The present invention contemplates a series of cartons to be filled with medicines arranged in doses by the pharmacist. For example, the carton may contain a plurality of pills, capsules, caplets or the like, located in tamper-apparent unit dose cups arranged in severable strips. The cartons are labeled and sealed by the pharmacist. When the carton is to be opened by the person in charge of drug dispensing, this is accomplished by pull tab means. The entire carton top is open on one longitudinal side and both ends, the top being hinged at a fold line along the other longitudinal side of the carton. The top therefore is complete and is of the nature of a planar flap. An open top tray is provided to receive one or more of the cartons. The open top tray has an individual hinged lid for each carton located therein, the hinged lid overlying the carton top. Means are provided to releasably affix the carton top to its respective tray lid so that opening and closing of the tray lid will simultaneously open and close the carton top. The tray lid is preferably made of transparent material so that the labeling on the carton top can be read therethrough.

Such an assembly is characterized by a number of advantages. First of all, it provides control, convenience and ease of medication handling. It greatly reduces the chances of spilling or the inadvertent transfer of medication from one carton to another. The individual tray lids tend to maintain their respective carton tops in closed position. The entire carton top is available for labeling. Each carton may contain a reorder reminder slip. At the time of reorder, the label from the carton can be removed and relocated on an order form to the pharmacist. The assembly can constitute a high capacity dispensing system meeting all of the regulatory requirements. When an individual tray lid and its respective carton top is open, the dispensing opening of the carton is the full dimension of the carton.

DISCLOSURE OF THE INVENTION

According to the invention there is provided a drug control and dispensing assembly for use alone or with the drawers of a medicine dispensing cabinet or cart. The assembly comprises at least one carton containing medicines and an open top tray sized to receive the at least one carton.

The tray comprises a pair of side walls, a pair of end walls and a bottom. Each carton comprises a generally rectangular structure having first and second side walls, end walls, a bottom and a top which, when the carton is opened is flap-like and planar.

When the at least one carton is located within the tray, it extends slightly above the upper edge of the tray walls. The tray has at least one individual lid corresponding to and overlying the top of the at least one carton. The at least one tray lid is substantially planar and is pivotally mounted in a pair of upstanding hinge elements located on the upper edges of the tray side walls. The at least one tray lid and its respective carton top are substantially coextensive. At least one of the carton top and the tray lid is provided with attachment devices to releasably attach the carton top to the tray lid so that opening and closing of the tray lid will simultaneously result in opening and closing of the carton top.

In a preferred embodiment of the drug control and dispensing assembly of the present invention, the tray is dimensioned to receive a plurality of such cartons and is provided with an individual hinged lid for each such carton. Each carton top is releasably attached to its respective tray lid. The tray lids are made of transparent material so that the labels or indicia on the carton tops affixed thereto are readable therethrough.

Figure 10:
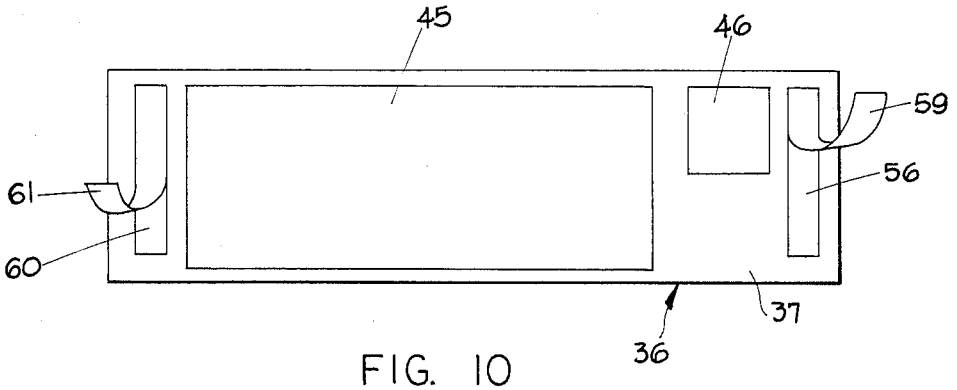
FIG. 10 is a plan view of one embodiment of the carton top of the present invention, to be used with the tray lid of FIG. 9.

FIG. **10*a* is an end view of the carton top of FIG. 10** as seen from the right thereof.

Figure 9:
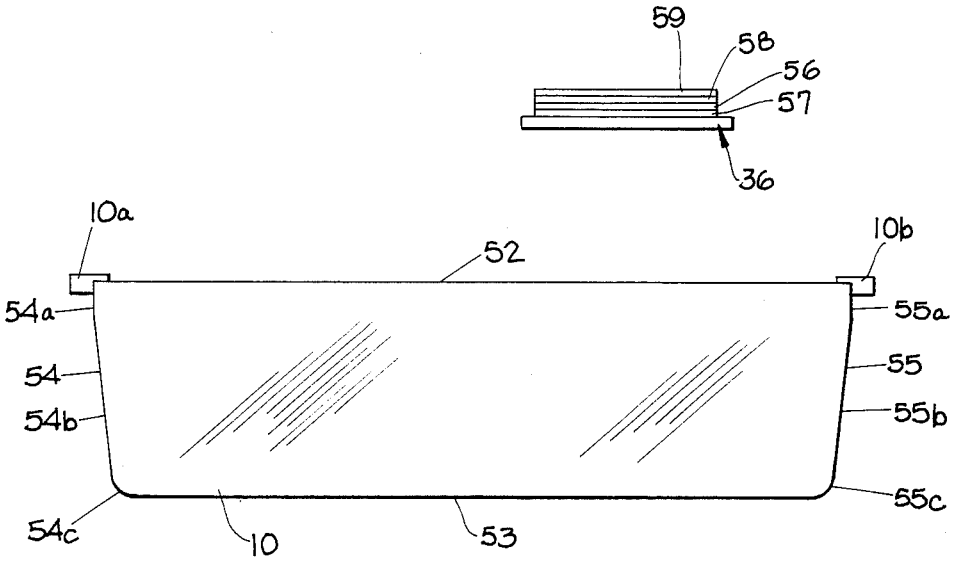
FIG. 9 is a plan view of one embodiment of the tray lid of the present invention.
Figure 11:
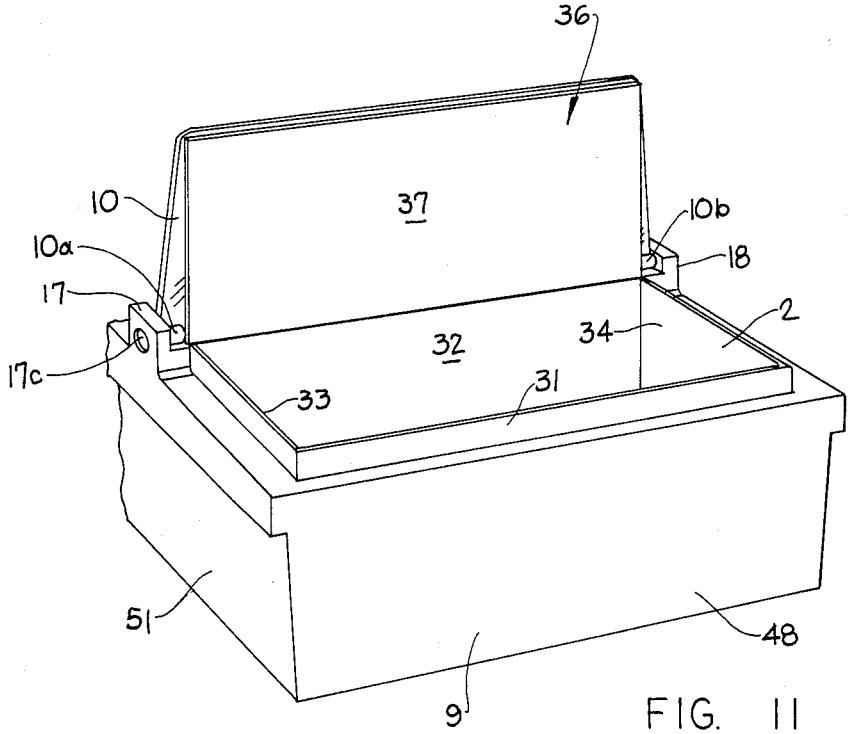

FIG. 11 is a fragmentary perspective view of a carton and the tray of the present invention illustrating the attachment of the carton top of FIG. 10 to the tray lid of FIG. 9.

Figure 12:
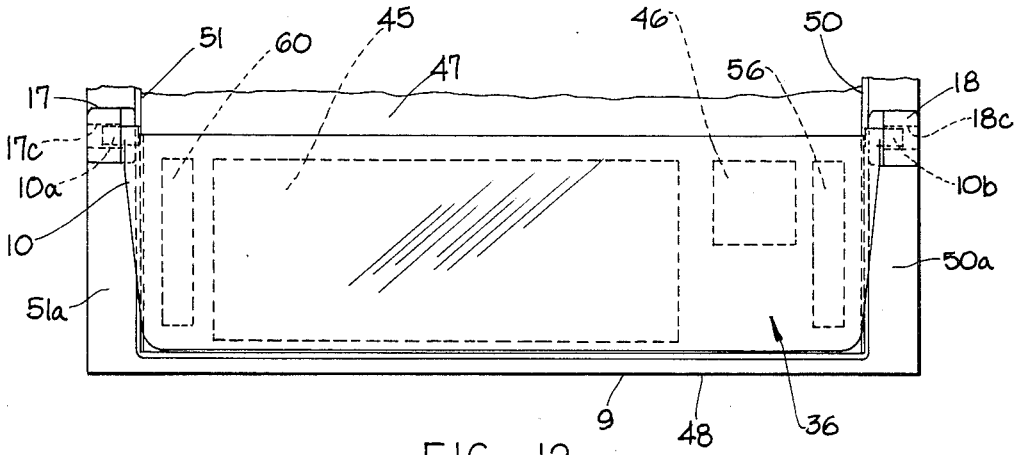

FIG. 12 is a fragmentary plan view of the tray of the present invention provided with the associated tray lid of FIG. 9 and carton top of FIG 10.

Figure 13:
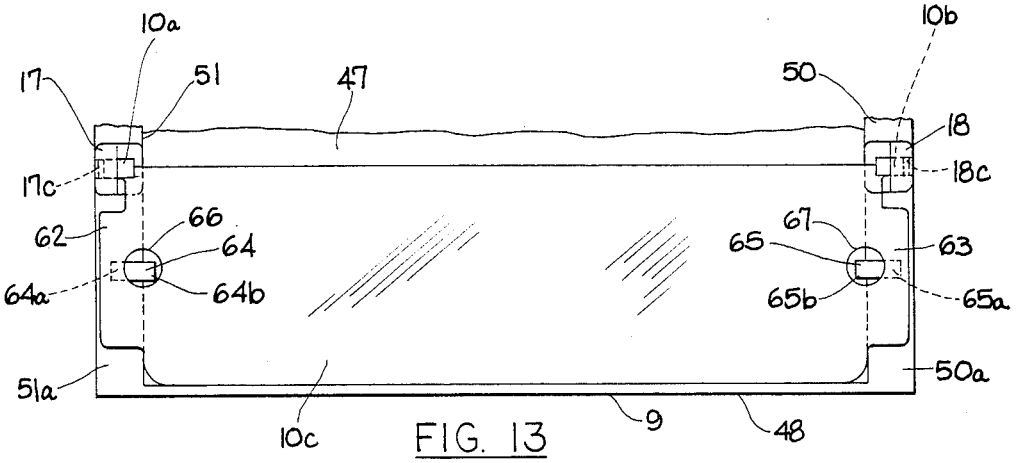

FIG. 13 is a fragmentary plan view of the tray of the present invention illustrating another embodiment of tray lid.

Figure 14:
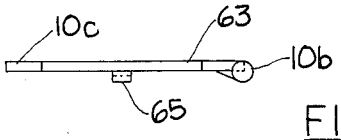

FIG. 14 is an end elevational view of the tray lid of FIG. 13.

Figure 15:
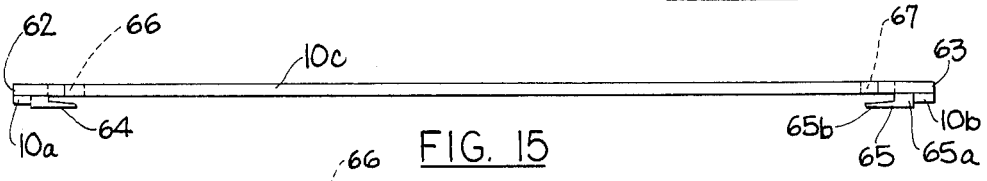

FIG. 15 is a front elevational view of the tray lid of FIG. 14.

Figure 16:
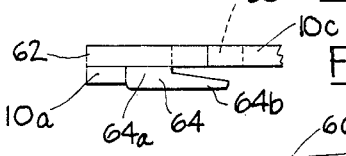

FIG. 16 is an enlarged fragmentary view of the left-hand attachment means of the tray lid of FIGS. 13 and 15.

Figure 5:
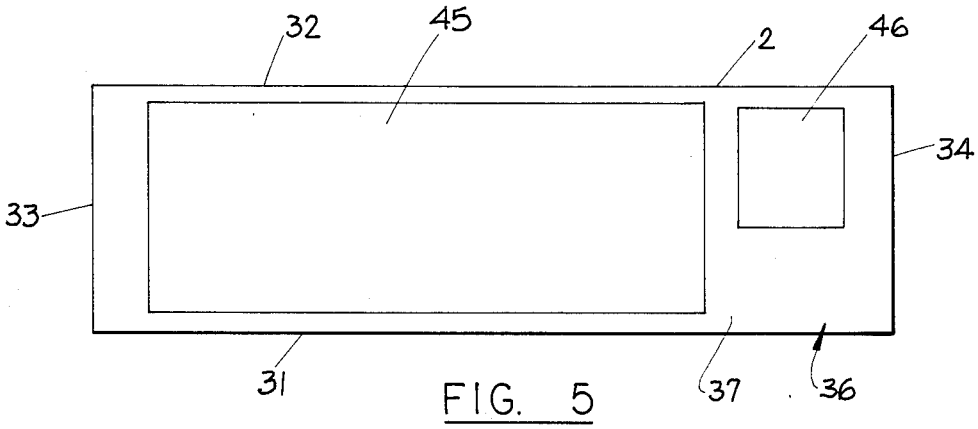
FIG. 5 is a plan view of the carton of FIG. 2, illustrating labels or indicia thereon.
Figure 17:
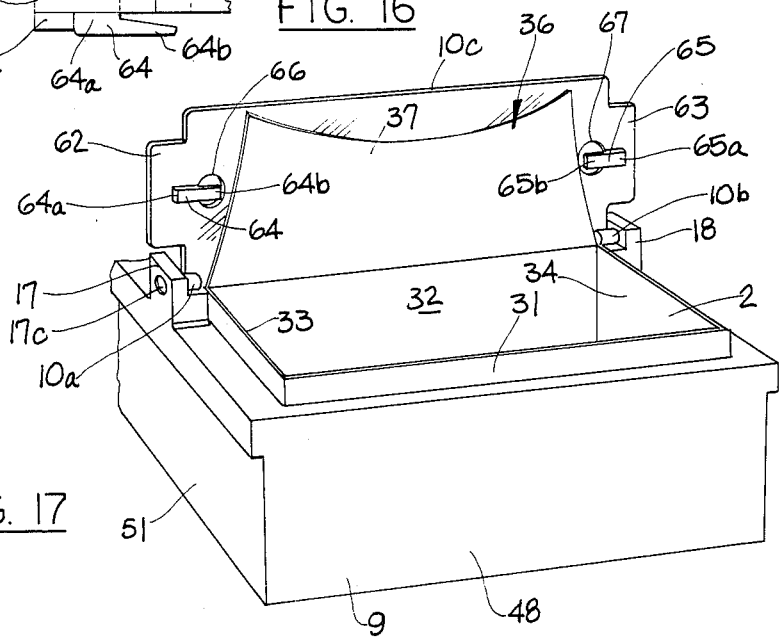

FIG. 17 is a fragmentary perspective view of a tray and carton of the present invention illustrating the method of attachment of the carton lid of the type shown in FIG. 5 to a tray lid of the type illustrated in FIGS. 13–16.

Figure 18:
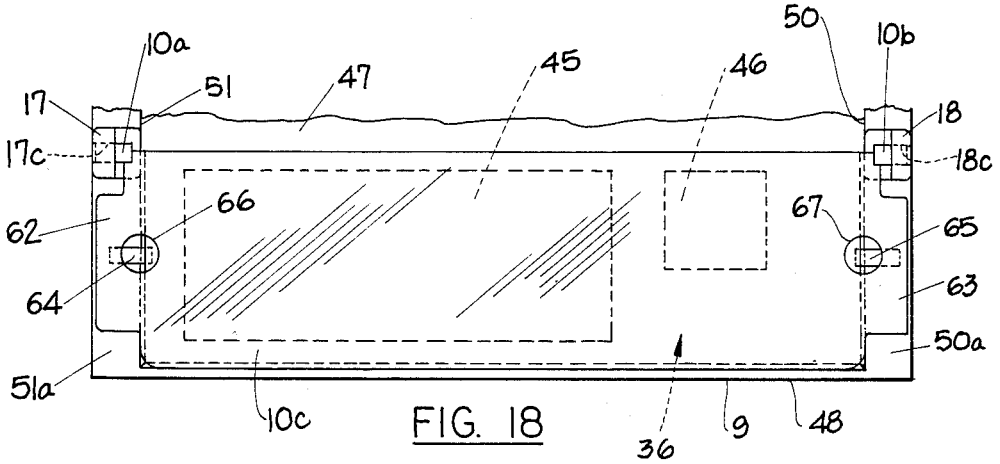

FIG. 18 is a fragmentary plan view of the structure of FIG. 17 illustrating the carton top attached to the tray lid.

Figure 19:
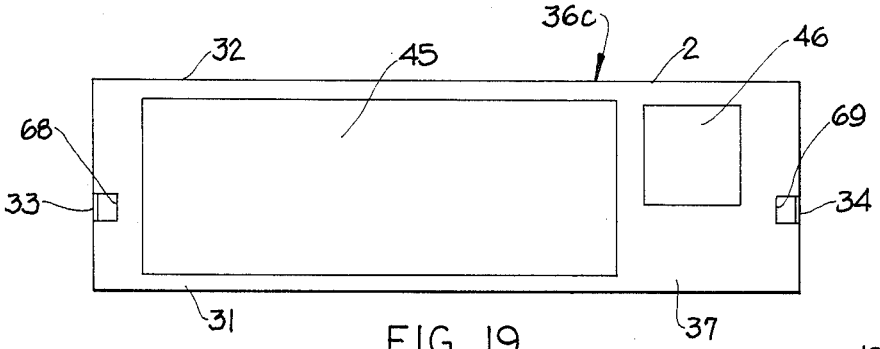

FIG. 19 is a plan view of another embodiment of carton top.

Figure 20:
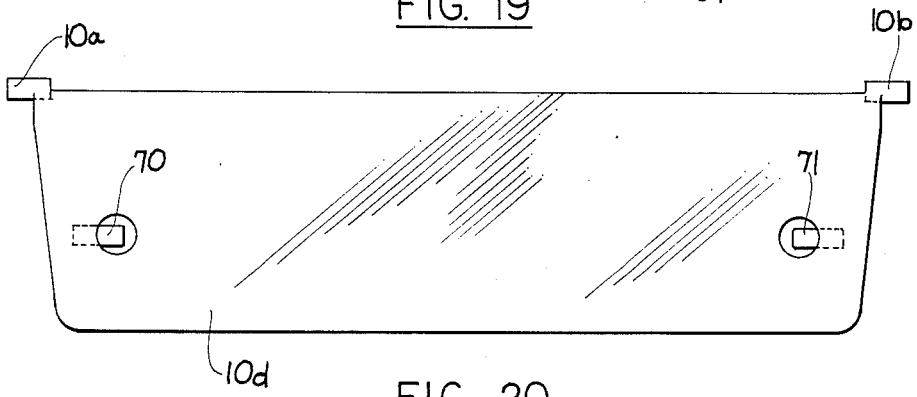

FIG. 20 is a plan view of another embodiment of tray lid to be used with the carton top of FIG. 19.

Figure 21:
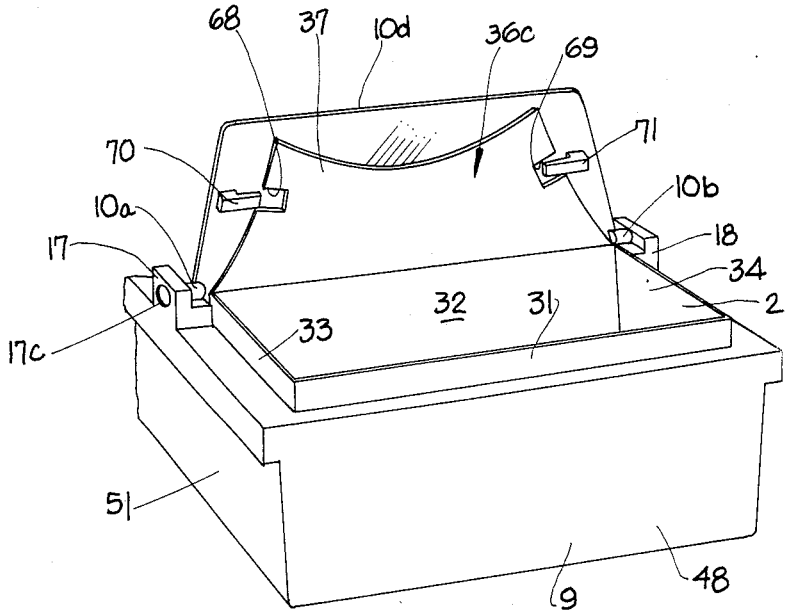

FIG. 21 is a fragmentary perspective view, similar to FIGS. 11 and 17, and showing the manner of attachment of the carton top of FIG. 19 to the tray lid of FIG. 20.

Figure 22:
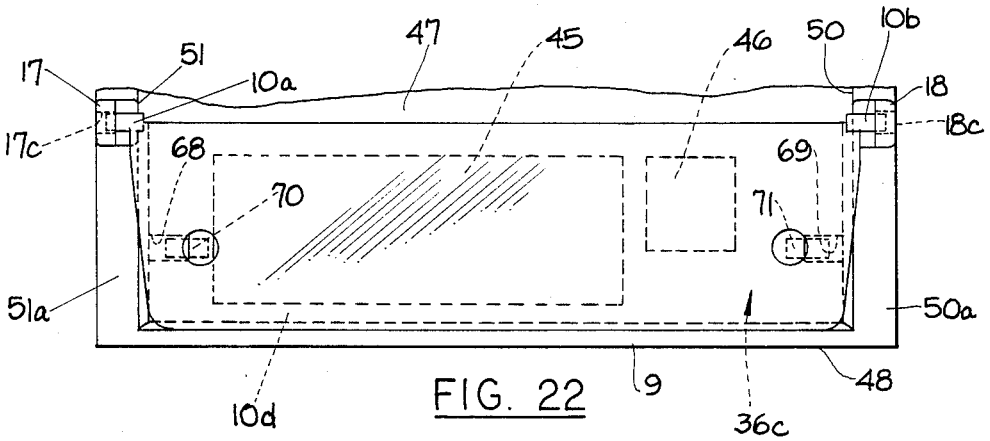

FIG. 22 is a fragmentary plan view of the structure of FIG. 21 illustrating the carton top affixed to the tray lid.

Figure 23:
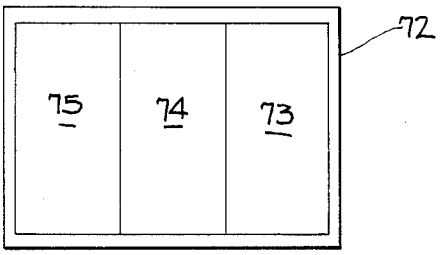

FIG. 23 is a simplified diagrammatic view illustrating a plurality of drug control and dispensing assemblies of the present invention located in the drawer of a medicine dispensing cabinet or cart.

DETAILED DESCRIPTION OF THE INVENTION

Figure 1:
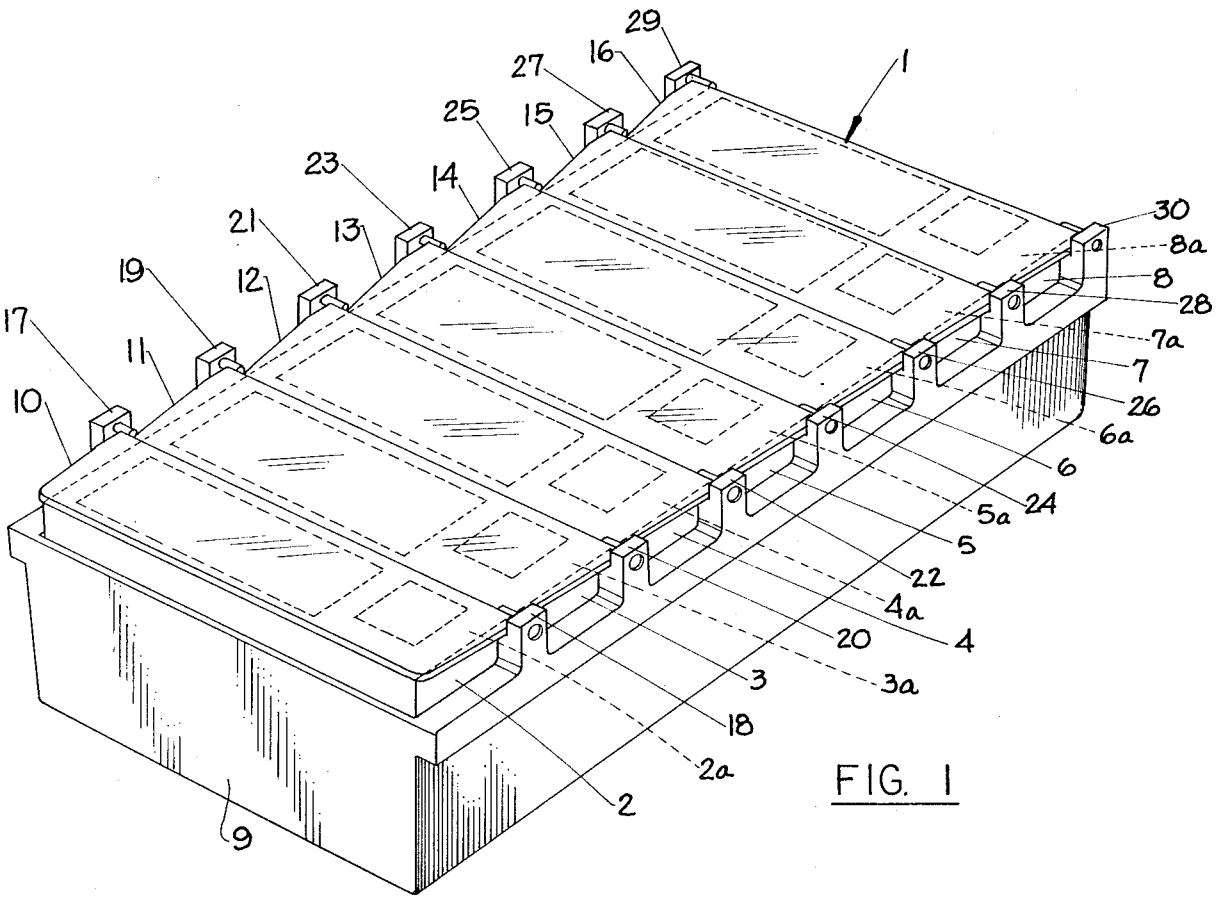
FIG. 1 is a perspective view of the drug control and dispensing assembly of the present invention.

Reference is first made to FIG. 1 wherein an exemplary drug control and dispensing assembly of the present invention is illustrated in perspective. The assembly is generally indicated at 1 and comprises a plurality of substantially identical, medicine containing cartons 2 through 8 received within an open-top tray 9. Each of the cartons 2 through 8 has a planar, flap-like top 2*a* through 8*a*. The tray 9 is provided with an individual lid 10 through 16 for each of the cartons 2–8, respectively. Each of the tray lids 10 through 16 is pivotally mounted in a pair of hinge elements 17-18, 19-20, 21-22, 23-24, 25-26, 27-28, and 29-30. The hinge elements 17-30 constitute integral parts of tray 9 and extend upwardly from the longitudinal edges thereof. It will be noted from FIG. 1 that each of the cartons 2 through 8 extend slightly above the top edges of tray 9. This provides a space beneath each end edge of each tray lid 10 through 16, enabling either end edge to be engaged by the finger of an operator to pivot the tray lid to an open position.

Reference is now made to FIGS. 2 through 5 wherein carton 2 is illustrated. It will be understood by one skilled in the art that cartons 3 through 8 are substantially identical to carton 2 and a description of carton 2 can stand as a description of any one of cartons 3 through 8.

Carton 2 is intended to be filled with medicine by a pharmacist. The medicine within carton 2 may take any appropriate form. For example, the medicine could constitute pills, capsules, caplets or the like located in tamper-apparent unit dose cups arranged in severable strips within carton 2. Such arrangements are known per se and do not constitute a part of the present invention. Once filled, the pharmacist closes and seals the carton for delivery to the hospital, nursing home, doctor's office or the like. Once the carton 2 has been opened and emptied, it is intended to be disposed of. Therefore, the carton 2 is preferably made of paperboard or the like. The precise nature of the blank from which carton 2 is made, and the manner in which it is erected, does not constitute a limitation on the present invention. Basically, the body of carton 2 comprises a front wall 31, a rear wall 32, end walls 33 and 34, and a bottom 35.

Figure 3:
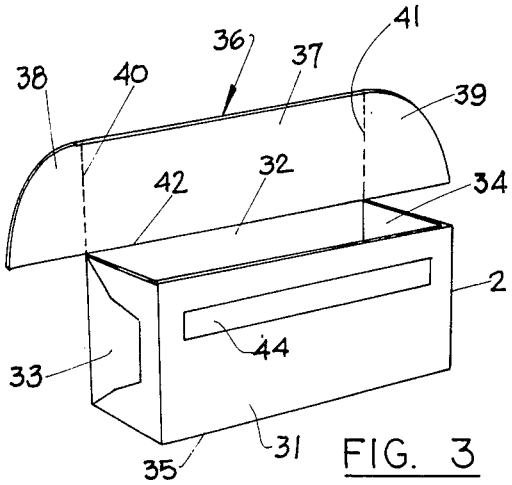
FIG. 3 is a perspective view of the carton of FIG. 2 with the pull tab removed and the carton top open.

The carton top, generally indicated at 36, in its original state includes a main rectangular panel 37 having side flaps 38 and 39 (see FIG. 3). The side flaps 38 and 39 are defined from the main rectangular panel 37 by perforated fold lines 40 and 41. It will be noted from FIGS. 3 and 4 that the main rectangular panel 37 of top 36 constitutes an integral part of rear wall 32 and is separated therefrom by fold or hinge line 42.

Carton top 36, in its original state, includes a tear strip 43 and a glue flap 44. When the pharmacist has filled the carton 2, the flaps 38 and 39 are bent slightly inwardly so as to enter the box as top 36 is closed, and the top is maintained closed by adhering glue flap 44 to the carton front wall 31.

To prepare the carton 2 for use in the drug control and dispensing assembly of the present invention, it is only necessary for the nurse or operator to remove the tear strip 43 from the carton. For this purpose, the tear strip 43 can be engaged at either end. It will be apparent from FIG. 2 that when the tear strip is removed, the carton top 36 is separated from glue flap 44 and is free to be opened. The top is opened to the position shown in FIG. 3, whereupon the flaps 38 and 39 are removed therefrom along perforated fold lines 40 and 41, respectively. At this point, all that remains of the original top is the main rectangular panel 37 hingedly attached to carton rear wall 32. The glue flap 44 remains permanently affixed to carton front wall 31.

Once the pharmacist has filled and closed carton 2, he will apply thereto one or more indicia bearing labels, such as labels 45 and 46 illustrated in FIG. 5. It will be understood that the nature and number of labels applied to the carton top 36 and the indicia printed thereon does not constitute a part of or a limitation on the present invention. It would be possible, for example, to print or otherwise apply indicia directly to the panel 37 of carton top 36. In a non-limiting example, label 45 may contain the patient's name, the doctor's name, the pharmacist's initials, the prescription number, the date, identification of the medicine contained therein and its strength, and instructions for administering the medicine. The label 46, if used, may indicate at a glance the time or times the medicines are to be given and the label may carry such indicia as "PM", "AM", "NOON", "PRN" (as needed), "HS" (hour of sleep), and "SPECIAL" (where special instructions are given for the administration of the medicine such as every-other-day or the like). Again, it will be understood that cartons 3 through 8 may be substantially identical to carton 2 differing only perhaps in the labeling and indicia thereon.

Figure 6:
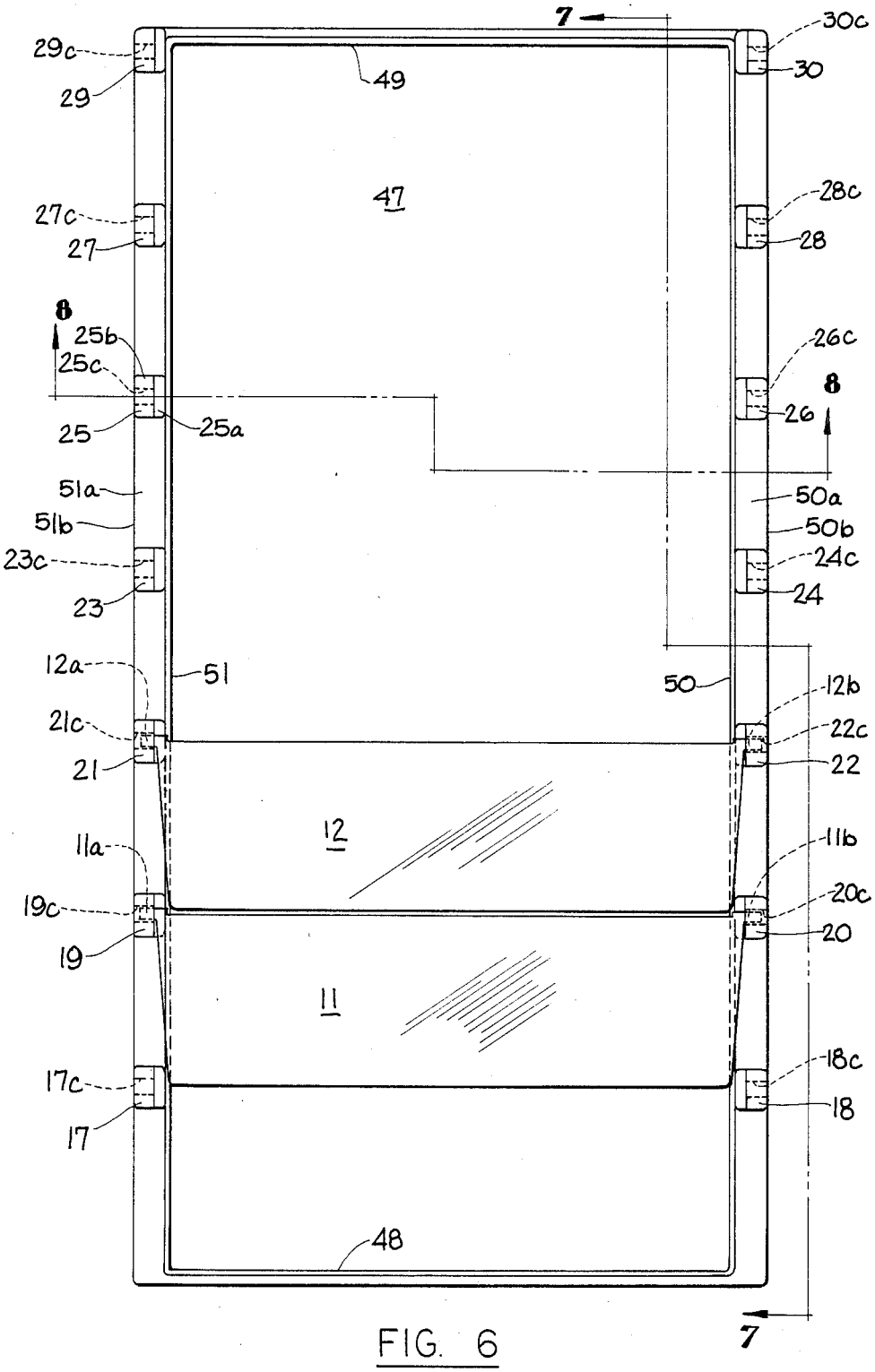
FIG. 6 is a plan view of the tray of the present invention illustrating two tray lids mounted in place.
Figures 7, 8:
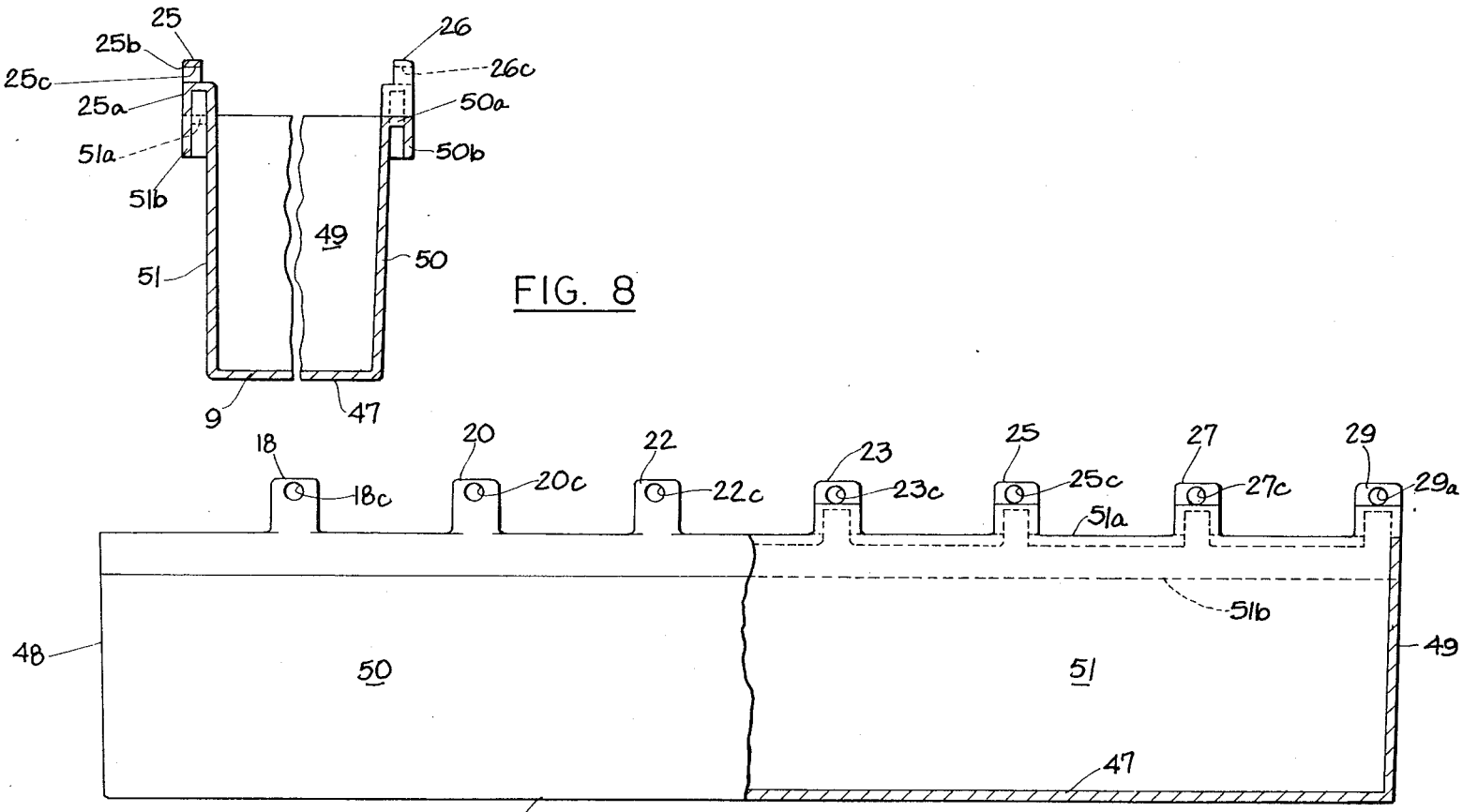
FIG. 7 is a side elevational view of the tray of FIG. 6, partly in cross-section, taken along section line 7—7 of FIG. 6.
FIG. 8 is a cross-sectional view taken along section line 8—8 of FIG. 6.

Reference is now made to FIGS. 6, 7 and 8 wherein the tray 9 is illustrated. The tray 9, of course, is intended for reuse and may be made of any appropriate material for that purpose. The tray 9 lends itself well to being molded of plastic material and is preferably made of a plastic material suitable for use in a medical environment. Tray 9 comprises a planar bottom 47 provided with an upstanding front wall 48, an upstanding rear wall 49 and first and second upstanding, longitudinal side walls 50 and 51.

As is clearly shown in FIGS. 6 through 8, the longitudinal side wall 50 is provided with a laterally extending flange 50*a* having a downwardly depending portion 50*b*. As is clear from FIGS. 1 and 8, the ends of flange portions 50*a* and 50*b* are closed by front wall 48 and rear wall 49. In similar fashion, side wall 51 has a laterally extending flange portion 51*a* and downwardly depending flange portion 51*b*, the ends of which are closed by front wall 48 and rear wall 49.

It will be noted from FIG. 6 that flange portion 51*a* of side wall 51 supports hinge elements 17, 19, 21, 23, 25, 27, and 29. In similar fashion, the flange portion 50*a* of side wall 50 supports hinge elements 18, 20, 22, 24, 26, 28, and 30. In FIG. 8, a cross-sectional view of hinge element 25 is shown. The hinge element 25 comprises an upstanding hollow base portion 25*a* surmounted by a solid portion 25*b* having about half the transverse width of base portion 25*a* and provided with a perforation 25*c* extending therethrough. It will be apparent from FIG. 8 that hinge element 25 constitutes an integral, one-piece part of tray 9. Hinge elements 17, 19, 21, 23, 27, and 29 are identical to hinge element 25. Hinge elements 18, 20, 22, 24, 26, 28, and 30 are also identical to hinge element 25, except that they constitute a mirror image thereof. In FIGS. 6 through 8, the perforation of each hinge element is designated by the index numeral of that hinge element followed by "c".

To complete the basic structure of the drug control and dispensing assembly of the present invention, FIG. 9 illustrates lid 10 of tray 9. It will be understood that all of lids 11 through 16 can be identical to lid 10, and therefore a description of lid 10 can serve as a description of all of the tray lids. The lid 10 comprises an elongated planar member made of any appropriate material. Preferably, lid 10 is molded of an appropriate plastic material. Furthermore, it is preferable that the plastic material of lid 10 be transparent for reasons which will be apparent hereinafter.

The lid 10 has a rear edge 52 of such length as to be just nicely received between hinge elements 17 and 18 (see FIG. 1). Lid 10 has a forward edge 53 substantially equal in length to the forward edge of the main panel 37 of carton top 36 (see FIGS. 4 and 5). The side edges 54 and 55 of lid 10 have first portions 54*a* and 55*a*, near rear edge 52, which are substantially parallel. Side edges 54 and 55 have second portions 54*b* and 55*b* which slope forwardly and inwardly to meet front edge 53 in rounded front corners 54*c* and 55*c*.

The lid 10 is provided at its rearward corners with integral, laterally extending hinge pins 10*a* and 10*b*. These hinge pins are adapted to be received in hinge element perforations 17*c* and 18*c*. In this way, lid 10 is rotatively mounted and is readily shiftable between a substantially horizontal closed position and a substantially vertical open position. All of lids 10 through 16 are shown so mounted in FIG. 1. Lids 11 and 12 are illustrated in their mounted, closed position in FIG. 6. It will be evident from FIG. 6 that the side edges of the lids taper inwardly and forwardly so as to clear the hinge elements located near the front corners thereof. Thus the forward portion of lid 11 clears hinge elements 17 and 18 and the forward portion of lide 12 clears hinge elements 19 and 20. As also can be clearly seen in FIG. 6, hinge pins 11*a* and 11*b* of lid 11 are located respectively in the perforations 19*c* and 20*c* of hinge elements 19 and 20. Similarly, hinge pins 12*a* and 12*b* of lid 12 are located respectively in perforations 21*c* and 22*c* of hinge elements 21 and 22.

A novel feature of the present invention lies in the fact that means are provided to temporarily attach the carton tops to their respective tray lids, so that when a tray lid is opened and closed, its respective carton top will open and close with it. This can be accomplished in a number of ways. For example, each carton top may be provided with appropriate attachment devices. Alternatively, each tray lid may be provided with appropriate attachment devices. Finally, each tray lid and its respective carton top may both be provided with cooperating attachment devices.

Reference is now made to FIGS. 9, 10, 11, and 12 which illustrate an exemplary embodiment wherein the attachment devices are located on each carton top. The embodiment will be described in terms of the top of carton 2 and the cooperating tray lid 10. It will be understood that the tops of remaining cartons 3 through 8 can similarly be provided with attachment devices to cooperate in the same manner with their respective tray lids 11 through 16.

FIG. 10 illustrates the main rectangular panel 37 of top 36 of carton 2 (see FIGS. 2 through 5). In FIG. 10, labels 45 and 46 are shown. The embodiment of FIG. 10 differs from the embodiment of FIG. 5 in that the top 36 adjacent its right-hand end is provided with a carrier strip 56 preferably having a thickness approximately equal to the thickness of labels 45 and 46. As is best seen in FIG. 10A, carrier strip 56 is provided on its underside with a layer of permanent adhesive 57, by which it is firmly and permanently affixed to the upper surface of top 36. Carrier strip 56 is provided on its upper surface with a layer 58 of removable adhesive. The removable adhesive layer 58 is, in turn, surmounted by a release liner 59. It will be understood by one skilled in the art that the carrier strip 56, adhesive layers 57 and 58, and release liner 59 are greatly exaggerated in thickness in FIG. 10A, for purposes of a clear showing. In similar fashion, the top 36 is provided near its left-hand end with a carrier strip 60 having a layer of permanent adhesive on its bottom surface and a layer of removable adhesive on its top surface, surmounted by a release liner 61.

Figure 2:
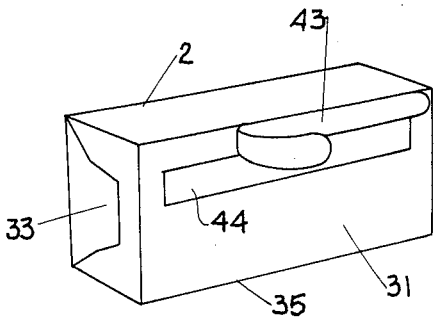
FIG. 2 is a perspective view of an exemplary carton provided with a pull tab.
Figure 4:
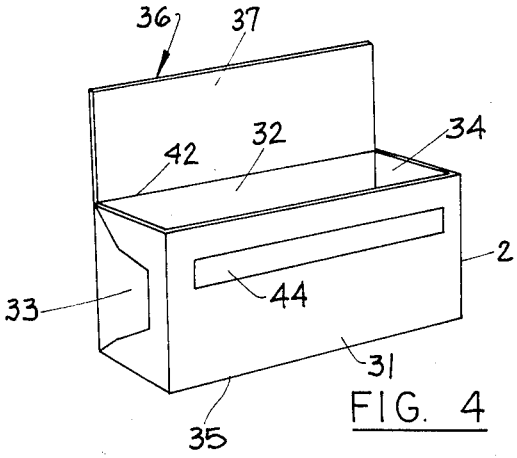
FIG. 4 is a perspective view of the carton of FIG. 2 in its final open condition with the side flaps of the top removed.

Once the carton 2 has been opened, as described with respect to FIGS. 2 through 4, the carton is inserted in tray 9 in front of tray lid 10. At this point, release liners 59 and 61 are removed from their respective carrier strips 56 and 60 and the carton top 36 and tray lid 10 are brought to an upright position as shown in FIG. 11 whereupon their edge portions are manually squeezed together to cause the removable adhesive of carrier strips 56 and 60 to adhere to tray lid 10. In this manner, carton top 36 is releasably attached to tray lid 10 and opening and closing of tray lid 10 will result in simultaneous opening and closing of carton top 36. The completed assembly with the carton top 36 and tray lid 10 in their closed positions is shown in FIG. 12. As is apparent from FIG. 12, the labels 45 and 46 are easily readable through tray lid 10.

Another exemplary embodiment of the present invention is illustrated in FIGS. 13 through 18. In this embodiment, the attachment devices for releasably affixing the carton top to the tray lid are located on the tray lid, itself. The carton top is without modification and may be considered to be identical to that illustrated in FIG. 5. Again, this embodiment will be described with respect to carton 2 and its associated tray lid. Since the tray lid differs in some respects to tray lid 10 of FIGS. 1 and 9, the tray lid has been designated by index numeral 10*c*. Otherwise, like parts have been given like index numerals.

FIG. 13 illustrates the forward end of tray 9 with lid 10*c* pivotally mounted in hinge elements 17 and 18. Lid 10*c* differs from lid 10 of FIGS. 9 and 12 only in two respects. First of all, lid 10*c* is provided at its end edges with lateral extensions 62 and 63. The extensions 62 and 63 are mirror images of each other and are so sized as to fit between adjacent hinge elements on tray 9, without interference therewith.

The second point of difference between lid 10*c* and lid 10 lies in the fact that lid 10*c* is provided on its underside with a pair of mirror image, opposed, hook-like tabs 64 and 65. The tabs 64 and 65 are further illustrated in FIGS. 14 through 16. Turning to FIG. 16, it will be noted that tab 64 constitutes an integral, one-piece part of lid 10*c*, having a downwardly depending main body portion 64*a* and a laterally extending portion 64*b* slightly spaced from the underside of lid 10*c*. It will be noted that the lid 10*c* has a perforation 66 overlying the portion 64*b* of tab 64. The perforation 66 is not a necessary element of the lid structure. Rather, it is the result of a more convenient molding procedure for lid 10*c*, having been made by a shut-off element, as will be understood by one skilled in the art. If tab 64 is made by other molding procedures, or were to constitute a separate element permanently affixed to the underside of lid 10*c*, perforation 66 would be eliminated. Tab 65 is substantially identical to tab 64, having a main body portion 65*a* and a laterally extending portion 65*b*, together with a shut-off hole 67. As indicated above, the lid 10*c* of FIGS. 13 through 16 is intended for use with a carton 2 having a top 36 of the type illustrated in FIG. 5. FIG. 17 is similar to FIG. 11 and illustrates the tray 9 with the carton 2 seated therein. To complete the assembly, the lid 10*c* and the carton top 36 are brought to a substantially vertical position. The side edges of the carton top are then squeezed slightly together so as to cause the top to bow. This enables the side edges of top 36 to be engaged beneath the lateral extensions 64*b* and 65*b* of tabs 64 and 65. In this way, the carton top 36 is associated with the tray lid 10*c* and will open and close therewith.

FIG. 18 is similar to FIG. 13, but illustrates the carton 2 in place within tray 9. As can be clearly seen through perforations 66 and 67 in lid 10*c*, the carton top 36 overlies the free ends of tabs 64 and 65 and is thus releasably attached to lid 10*c*. Again, labels 45 and 46 are clearly visible through the transparent tray lid 10*c*.

FIGS. 19 through 22 illustrate a third and preferred embodiment wherein both the carton top and its respective tray lid are provided with cooperating attachment devices. Again, this embodiment will be described with respect to carton 2 located in the forwardmost position within tray 9, it being understood that the tops of all of the cartons and all of the lids of tray 9 will be modified in the manner to be described. FIG. 19 is a plan view of carton 2. In this instance, the carton top is designated 36*c*, since it is slightly modified with respect to the version illustrated in FIG. 5. Otherwise, like parts have been given like index numerals. Again, the carton top 36*c* is illustrated as having been provided with labels 45 and 46. The carton top 36*c* differs from carton top 36 of FIG. 5 only in that a notch is provided in each of its end edges. These notches are shown at 68 and 69.

FIG. 20 is a plan view of a cooperating tray lid, this time indicated by index numeral 10*d*. The lid 10*d* is identical to lid 10 of FIG. 9, differing only in that it is provided with tabs 70 and 71. The tabs 70 and 71 are identical to tabs 64 and 65 of lid 10*c* of FIG. 13. The only difference lies in the fact that the tabs 70 and 71 are differently positioned with respect to lid 10*d*. The reason for this is illustrated in FIGS. 21 and 22. FIG. 21 is similar to FIG. 16 and shows carton 2 mounted in the forwardmost position within tray 9. Once so located, its top 36*c* and the tray lid 10*d* are brought to a near vertical position. The lateral edges of carton top 36*c* are squeezed inwardly, causing the carton top to bow as shown. This enables the lateral edges of the carton top to be engaged by tray lid tabs 70 and 71, at the positions of notches 68 and 69 in carton top 36*c*. FIG. 22 is similar to FIG. 18 and clearly showns the interengagement of tab 70 with notch 68 and tab 71 with notch 69. The structure of FIGS. 19 through 22 has the advantage over the structure of FIGS. 13 through 18 in that the interengagement of tabs 70 and 71 with notches 68 and 69 precludes movement of carton 2 in either longitudinal direction with respect to tray 9, when the lids are in their closed positions. In other words, should the next succeeding portion of tray 9 not have a carton located therein, and should tray 9 be subjected to a sudden rearward movement, it is not possible for carton 2 located therein to shift rearwardly of the tray into the next portion thereof, with consequent disengagement of carton top 36 with respect to tabs 70 and 71.

The drug control and dispensing assembly of the present invention has been described and illustrated in terms of a tray 9 capable of receiving seven (7) cartons 2. It will be appreciated by one skilled in the art that tray 9 could be so sized as to receive a single carton, being provided with a single lid to overlie the top of the single carton. Similarly, tray 9 could be so sized as to hold more than seven cartons, the tray being provided with a lid for each carton.

FIG. 23 is a semi-diagrammatic, simplified plan view of drawer adapted to receive a plurality of the drug control and dispensing assemblies of the present invention. Three such assemblies are shown at 73, 74 and 75. The drawer 72 could, of course, be dimensioned to receive a greater number of the assemblies, or a lesser number of the assemblies, as desired. The drawer 72 may be considered to be the drawer of a stationary medicine dispensing cabinet. On the other hand, the drawer 72 could constitute a drawer of a movable medical cart. Finally, the assembly of the present invention could be used alone and not in association of the drawer of a medical cabinet or medicine dispensing cart.

Modifications may be made in the invention without departing from the spirit of it. For example, in the embodiments described, substantially the entire top of each carton is releasably affixed to its respective tray lid and opens and closes therewith. The carton of the present invention and its top could be so constructed that only a portion of the top constitutes an openable flap-like top and is removably affixed to its respective tray lid to open and close therewith.

It is within the scope of the invention to eliminate side flaps 28 and 39 from the blank of the carton of the present invention.

What is claimed is:

1. A drug control and dispensing assembly for use alone and in association with the drawers of medicine dispensing cabinets and carts, said assembly comprising at least one carton containing medicines and an open top tray to receive said at least one carton, said tray comprising a pair of side walls, a pair of end walls and a bottom, said at least one carton being generally rectangular and having front and rear walls, end walls, a bottom and a flap-like planar top integral with said rear wall and shiftable between open and closed positions along a fold line between said top and said rear wall, said tray having at least one individual substantially planar lid corresponding to and overlying said top of said at least one carton, said tray lid and said carton top both having front and rear edges, end edges and upper and lower surfaces, said tray lid being pivotally mounted by a pair of hinge elements to said tray side walls, means to releasably attach said carton top to said tray lid with said carton top upper surface adjacent said tray lid lower surface, such that opening and closing of said tray lid will result in simultaneous opening and closing of said carton top, said attachment means comprising a pair of carrier strips having lower and upper surfaces, each of said carrier strips having a layer of permanent adhesive on its lower surface by which it is permanently affixed to the upper surface of said carton top near an end edge thereof, each of said carrier strips having on its upper surface a layer of removable adhesive surmounted by a release liner whereby when said at least one carton is located in said tray, said release liners are removed from said carrier strips and said carton top and said tray lid are pressed together, said carton top will be releasably affixed to said tray lid by said removable adhesive layers.

2. A drug control and dispensing assembly for use alone and in association with the drawers of medicine dispensing cabinets and carts, said assembly comprising at least one carton containing medicines and an open top tray to receive said at least one carton, said tray comprising a pair of side walls, a pair of end walls and a bottom, said at least one carton being generally rectangular and having front and rear walls, end walls, a bottom and a flap-like planar top integral with said rear wall and shiftable between open and closed positions along a fold line between said top and said rear wall, said tray having at least one individual substantially planar lid corresponding to and overlying said top of said at least one carton, said tray lid and said carton top both having front and rear edges, end edges and upper and lower surfaces, said tray lid being pivotally mounted by a pair of hinge elements to said tray side walls, means to releasably attach said carton top to said tray lid with said carton top upper surface adjacent said tray lid lower surface, such that opening and closing of said tray lid will result in simultaneous opening and closing of said carton top, said tray lid having end edge portions extending beyond the end edges of said carton top, said attachment means comprising a pair of tabs having a body portion extending from said lid lower surface in the area of said end edge portions and opposed hook-like portions spaced from said lid lower surface, the end edges of said carton top being engagable between said lower surface of said tray lid and said tab hook-like portions whereby said carton top is releasably affixed to said tray lid.

3. A drug control and dispensing assembly for use alone and in association with the drawers of medicine dispensing cabinets and carts, said assembly comprising at least one carton containing medicines and an open top tray to receive said at least one carton, said tray comprising a pair of side walls, a pair of end walls and a bottom, said at least one carton being generally rectangular and having front and rear walls, end walls, a bottom and a flap-like planar top integral with said rear wall and shiftable between open and closed positions along a fold line between said top and said rear wall, said tray having at least one individual substantially planar lid corresponding to and overlying said top of said at least one carton, said tray lid and said carton top both having front and rear edges, end edges and upper and lower surfaces, said tray lid being pivotally mounted by a pair of hinge elements to said tray side walls, means to releasably attach said carton top to said tray lid with said carton top upper surface adjacent said tray lid lower surface, such that opening and closing of said tray lid will result in simultaneous opening and closing of said carton top, said attachment means comprising a U-shaped notch with a base portion and side edges formed in each end edge of said carton top and a pair of tabs having body portions extending from said tray lid lower surface, with opposed hook-like portions spaced from said lid lower surface, said tabs being so positioned on said lower surface of said tray lid and said notches being so positioned along said end edges of said carton top that said carton top end edges are engagable at the bases of said notches between the lower surface of said tray lid and said hook-like portions of said tabs with the side edges of said notches lying to either side of the body portions of their respective tabs whereby said carton top is releasably affixed to said tray lid.

4. A drug control and dispensing assembly for use alone and in association with the drawers of medicine dispensing cabinets and carts, said assembly comprising a plurality of medicine containing cartons and an open top tray, each carton being generally rectangular and having front and rear walls, end walls, a bottom and a flap-like planar top integral with said rear wall and shiftable between open and closed positions along a fold line between said top and said rear wall, each carton having a long axis extending between its end walls, said tray being substantially rectangular and comprising a bottom, front and rear walls and a pair of side walls, said tray having a long axis extending from its front wall to its rear wall, said tray being so sized as to receive said cartons arranged therein with their long axes extending transversely of said long axis of said tray, said tray having an individual substantially planar lid for each of said cartons therein, each tray lid corresponding to and overlying said top of its respective carton, each of said tray lids and said carton tops having front, rear and end edges and upper and lower surfaces, each of said tray lids being pivotally mounted by a pair of hinge elements to said tray side walls, and attachment means for releasably attaching each of said carton tops to its respective tray lid with said carton top upper surface adjacent said tray lid lower surface, such that opening and closing each tray lid will simultaneously open and close its respective carton top, said cartons when mounted in said tray extending above said tray walls, said hinge elements extending upwardly from said tray walls such that when said tray lids are in their closed position they are substantially horizontal with their end edges spaced from said tray side walls by an amount sufficient to enable their manual engagement for shifting them between open and closed positions.

5. A drug control and dispensing assembly for use alone and in association with the drawers of medicine dispensing cabinets and carts, said assembly comprising a plurality of medicine containing cartons and an open top tray, each carton being generally rectangular and having front and rear walls, end walls, a bottom and a flap-like planar top integral with said rear wall and shiftable between open and closed positions along a fold line between said top and said rear wall, each carton having a long axis extending between its end walls, said tray being substantially rectangular and comprising a bottom, front and rear walls and a pair of side walls, said tray having a long axis extending from its front wall to its rear wall, said tray being so sized as to receive said cartons arranged therein with their long axes extending transversely of said long axis of said tray, said tray having an individual substantially planar lid for each of said cartons therein, each tray lid corresponding to and overlying said top of its respective carton, each of said tray lids and said carton tops having front, rear and end edges and upper and lower surfaces, each of said tray lids being pivotally mounted by a pair of hinge elements to said tray side walls, and attachment means for releasably attaching each of said carton tops to its respective tray lid with said carton top upper surface adjacent said tray lid lower surface, such that opening and closing each tray lid will simultaneously open and close its respective carton top, said attachment means for joining each carton top to its respective tray lid comprising a U-shaped notch with a base portion and side edges formed in each end edge of each of said carton tops, a pair of tabs on each tray lid, said tabs of each pair having body portions extending from said lower surface of their respective tray lid with opposed hook-like portions spaced from said lid lower surface, each pair of tabs being so positioned on said lower surface of its respective tray lid and said notches being so positioned along said end edges of each carton top that said end edges of each carton top are engagable at the bases of its notches between the lower surface of its respective tray lid and the hook-like portions of said tabs thereon, with the side edges of each notch lying to either side of the body portion of its respective tab, whereby each carton top is releasably affixed to its respective tray lid.

6. The drug control and dispensing assembly claimed in claim 5 including indicia on said carton tops, said tray lids being transparent so that said indicia can be read therethrough.

7. The drug control and dispensing assembly claimed in claim 6 wherein said cartons when mounted in said tray extend above said tray walls, said hinge elements extending upwardly from said tray walls such that when said tray lids are in their closed position they are substantially horizontal with their end edges spaced from said tray side walls by an amount sufficient to enable their manual engagement for shifting them between open and closed positions.

8. The drug control and dispensing assembly claimed in claim 7 wherein said cartons are disposable and made of paperboard and said tray and its lids are reusable and made of plastic material.

9. The drug control and dispensing assembly claim in claim 8 wherein said flap-like top comprises the entire top of said carton.

* * * * *